US007293393B2

(12) United States Patent
Kelly et al.

(10) Patent No.: US 7,293,393 B2
(45) Date of Patent: Nov. 13, 2007

(54) PERIMETER CLIP FOR SEISMIC CEILINGS

(75) Inventors: Joseph J. Kelly, Spring City, PA (US); William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 633 days.

(21) Appl. No.: 10/766,415

(22) Filed: Jan. 27, 2004

(65) Prior Publication Data

US 2005/0160696 A1 Jul. 28, 2005

(51) Int. Cl.
*E04C 2/42* (2006.01)

(52) U.S. Cl. ..... 52/665; 52/506.07; 52/733.1; 52/167.1

(58) Field of Classification Search ..... 52/712, 52/698, 506.06, 665, 506.07, 220.6, 733.1, 52/289, 489.1, 506.08, 506.09, 506.1, 664, 52/483.1, 489.2, 167.1, 167.3; 403/63, 66, 403/70, 230, 116

See application file for complete search history.

(56) References Cited

U.S. PATENT DOCUMENTS 3,596,942 A * 8/1971 Zoebelein ..... 403/230
3,798,865 A * 3/1974 Curtis ..... 52/665
4,610,562 A 9/1986 Dunn
4,715,161 A 12/1987 Carraro et al.
4,893,961 A * 1/1990 O'Sullivan et al. ..... 403/232.1
5,046,294 A 9/1991 Platt
5,522,193 A * 6/1996 Sommerstein et al. ..... 52/235
5,590,503 A * 1/1997 Spronken ..... 52/677
6,200,060 B1 * 3/2001 Vernay ..... 403/151
6,612,087 B2 * 9/2003 diGirolamo et al. ..... 52/712
6,629,391 B1 * 10/2003 Børresen et al. ..... 52/200
2004/0118075 A1 * 6/2004 Zadeh ..... 52/715

FOREIGN PATENT DOCUMENTS

AU 260978 5/1963

OTHER PUBLICATIONS

NRM News Release Memo, dated Sep. 1, 1991—2 pages.
USG Memo Re: USG AC-M7 Attachment Clip—3 pages.

* cited by examiner

*Primary Examiner*—Richard Chilcot
*Assistant Examiner*—William Gilbert
(74) *Attorney, Agent, or Firm*—Eugene Chovanes

(57) ABSTRACT

A perimeter clip attached to a wall molding that supports a beam in a suspended ceiling intended to survive seismic disturbances. The clip is capable, during an earthquake, of permitting an end of a beam at one end of a connected line of beams, in a grid, to slide while being supported in the clip, or, in the alternative, to secure an end of a beam to the wall molding.

5 Claims, 4 Drawing Sheets

PERIMETER CLIP FOR SEISMIC CEILINGS

BACKGROUND OF THE INVENTION (1) Field of the Invention

The invention relates to ceilings capable of surviving seismic disturbances. The ceilings are of the suspended type that have a grid of interconnected metal beams hung from a structural ceiling. Panels are supported in the grid openings.

(2) Description of the Related Art

Suspended ceilings have a grid of beams hung from a structural ceiling by wires. Panels are supported in the grid openings. An angle wall molding runs around the perimeter of the ceiling and supports the ends of the grid beams. Such a ceiling is shown in U.S. Pat. No. 4,827,681, incorporated herein by reference.

The beams are roll formed of strip steel bent, in cross section, into a vertically extending web, horizontally extending flanges at the bottom of the web, and a bulb at the top of the web. The beams are interconnected into a grid. The grid is hung with wires from the structural ceiling, within the vertical walls of the individual rooms of a building. Such walls include structural walls as well as interior partition walls. A wall molding having an angle cross section supports the ends of the beams of the grid. An upper extending leg of the angle forms a face that is fastened against the wall, and the horizontal extending leg of the angle forms a ledge which receives and supports the beams. The end of the beam may simply rest on the ledge, or the beam flange may be secured to the ledge as by a self-tapping screw. The width of the ledge is usually about equal to the width of the beam flange, so, when viewed from below, the visual effect is a pleasing one.

In some instances, a perimeter clip is used to secure the ends of the beams to the wall molding. Such a clip is shown in U.S. Pat. No. 5,046,294, incorporated herein by reference. Such a perimeter clip is fixed on the wall molding at each end of a line of beams, and an end of a beam at the end of a line is fixed in a clip.

In a ceiling approved for an installation where a seismic event may occur, it is required that the beams in a grid be allowed to move relative to the side walls. Wires and the angle wall molding were relied on to keep the grid of beams supported in the ceiling, while allowing the beams to slide on the wall molding. To permit a beam to shake while supported on a ledge of a wall molding, seismic building codes often require a minimum two inch ledge on the wall molding to permit the beam end to slide on the ledge, without sliding off the ledge, during a quake. In such seismic codes, one end of a line of connected beams in the grid is required to be fixed to the wall molding; the other end must be free to slide back and forth longitudinally of the line of beams on the two inch ledge. Such a two inch wide ledge, however, is visually incompatible with the rest of the grid ceiling, when viewed from below, since the flanges on the beam are generally less than 1 inch wide.

SUMMARY OF THE PRESENT INVENTION (1) In General

The present invention relates to a new use for the perimeter clip of the '294 patent, as modified herein.

The new use of the modified '294 clip eliminates, in a suspended ceiling subject to seismic forces, the need for a 2 inch wide horizontal ledge on the angle wall molding that supports the ends of the grid beams. The invention permits the use, in such a ceiling, of a wall molding ledge of about ⅞ inch, as is now used in non-seismic ceilings, that is usually compatible with, and in harmony with, the beam flanges, which are visible from below.

The perimeter clip, as shown in the '294 patent as modified herein, is desirably formed from a single, stamped flat piece of sheet metal, bent into the finished shape.

The beam end, in a line of connected beams in a grid, is not fixed, or secured, to a perimeter clip at both ends of the line of connected beams, as taught in the '294 patent, but one end of the line of connected beams is free to slide lengthwise of the line, in the clip, in the event of seismic occurrence.

The clip is in general a right-angle form, wherein one leg of the right angle is hooked over the vertical web of the wall molding and secured to the wall by self-tapping screws, and the other leg of the clip extends at right angles to the wall to receive the end of the grid beam. In the clip of the invention, it is this leg of the '294 clip that is modified to extend from the wall about 2⅜ inches. The beam, at one end, of a line of connected beams, as stated above, and as required by the seismic code, is suitably secured in the clip. In the clip of invention, this occurs by tightening up a self-tapping screw in a slot. On the beam, at the other end of the line of connected beams, the self-tapping screw in the slot is not tightened, and the beam is free to slide in the clip on the screw that serves as a slidable pin, so that the beam is not fixed to the wall molding.

In the invention, the clip of the '294 patent, with the modification disclosed herein, is used on an angle wall molding, as shown in the '294 patent, that extends around the perimeter of a suspended ceiling. With the clip of the invention, the angle wall molding can have a ledge of about ⅞ inch wide, and still satisfy the seismic code requirements, which generally, as set forth above, require a two inch ledge on the wall molding, to keep the end of a beam from sliding off during a quake.

In a normal rest position, the flange at the end of the beam end is above, and close to or in contact with the ledge, so that there is a pleasing view from below, with no vertical or horizontal gaps between the beam flange, and the ledge.

The perimeter clip itself is hidden from view from below by the wall molding, the beam flanges, and the ceiling panels in the grid openings. The clip permits the width of the horizontal ledge of the wall molding to conform to the width of the flanges of the grid beams, to yield a pleasing and harmonious visual effect from below.

(2) The Modification

The leg of the perimeter clip of the invention, in which the end of the beam rests, is extended in the '294 clip, to at least 2⅜ inches from the wall, beyond the wall molding ledge. In forming the ceiling grid, a beam is installed in the leg of the clip, with the end that is free to slide, spaced about ¾ inches from the wall, at a rest position. The other end of the line of connected beams is secured to the clip, and is not free to slide. During an earthquake, the end of the beam in the clip of the invention, that is free to move, can move up to ¾ inches away or toward the wall, while still being supported by the perimeter clip of the invention, which is attached to the wall molding.

Under normal conditions, at a rest position, the ledge of the wall molding continues to provide an attractive covering below the ends of the beams, as well as a covering below the clip, around the perimeter of the room, but the actual vertical support of a beam end, though the beam end is permitted to slide during a quake, is given by the perimeter clip of the invention, which is hooked onto the face of the wall molding.

(3) The Slot

The leg of the clip, in which the end of the beam slides during a quake, has a continuous slot that, from the beam rest position, toward the wall, is horizontal, and away from the wall, is inclined. A self-tapping screw is passed through the slot and the beam, piercing the end of a beam, at a right angle thereto. The screw, which acts as movable pin, rides in the slot, and lifts the beam end above the ledge as the beam moves away from the wall during a quake. As the beam moves back toward the wall, in its reciprocating movement during a quake, the beam end clears the edge of the ledge of the wall molding, so there is no interference between the beam end and the edge of the wall molding ledge.

The end of a line of beams can be fixed in the clip by tightening up the self-tapping screw, in the slot, so that it binds the web of a beam in the extended leg of the clip.

The slot in the leg forward of the slot mid-position, toward the wall molding face, is horizontal, so that as the beam moves toward the wall in its reciprocal motion during an earthquake shake, the beam end movement is kept horizontal, by the screw, which acts as a movable pin, riding in the slot.

DETAILED DESCRIPTION OF THE INVENTION

Figure 2:
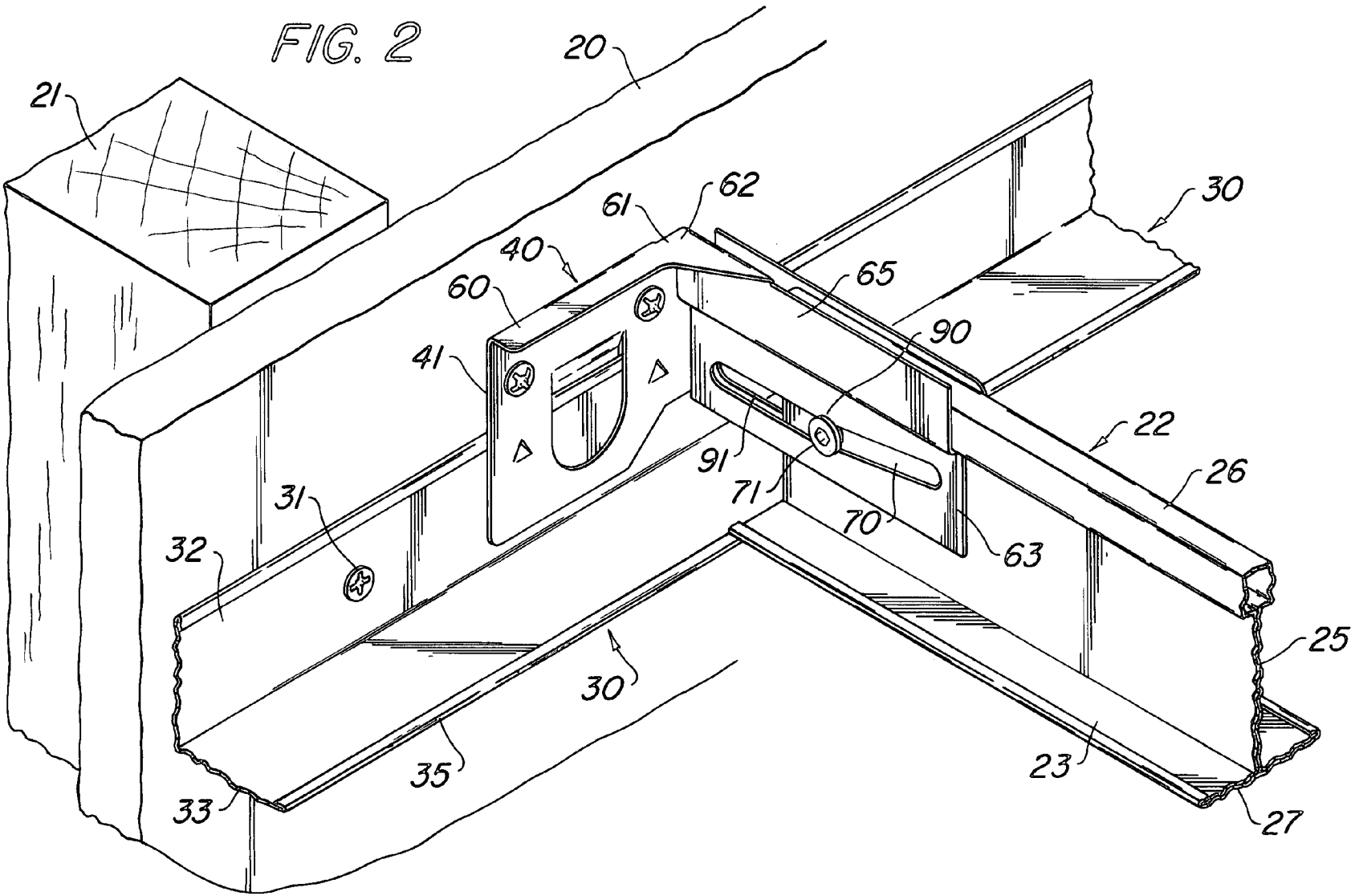
FIG. 2 is a fragmentary isometric view, illustrating a portion of drywall construction to which a segment of an angle wall molding is secured. The clip of the invention is hooked to the vertical face of the perimeter angle wall molding, in the desired position. One end of a grid beam is inserted into a leg of the clip at its normal rest position, where it is free to slide in the event of a seismic disturbance, or in the alternative, is secured in the clip.

As seen in FIG. 2, a vertical dry, or plastered, wall 20 is supported from a wood post structure 21. The wall 20 forms one side of a room within a building and generally extends from the floor to a structural ceiling.

A suspended ceiling of the grid type as shown, for instance, in the '681 patent referred to above, has a beam 22 in the form of an inverted T. Beam 22 integrally has a flange 23, a web 25, and a bulb 26. Beam 22 is roll formed from a longitudinally extending flat strip bent to form the beam elements. A cover piece 27 is wrapped around the flange 23 of the beam and is painted a desired color. Such beams 22 are well known in the art and are interconnected to form the grid structure for the panels that are laid in the grids.

An angle wall molding 30 is secured to wall 20 by screws or fasteners 31. The wall molding 30 extends horizontally along the wall 20 at the desired suspended ceiling height. Wall molding 30 forms an angle in cross section having a wall molding vertical face 32 and a wall molding horizontal ledge 33. The wall molding 30 is formed of a continuously extending strip bent into folds 35 to form smooth edges, and bent at a right angle along the longitudinal center line to form face 32 and ledge 33. The face 32 and ledge 33 each are of a width approximately equal to the width of the flange portion 23 of beam 22, for instance, so when the ceiling is in place, the wall molding ledge 33 and flange portion 23 are uniform in appearance.

The beam 22 does not have an offset portion as taught in the '294 patent, since this would interfere with the free sliding of the beam 22 in the clip 40, as described later, during an earthquake.

The perimeter clip 40 of the invention is used to firmly secure the end of beam 22 to wall molding 30 at one end of the beam 22, in a line of connected beams, and to slidably support end of the beam 22 at the other end of the line, independently of wall molding ledge 22.

The perimeter clip 40 of the invention is that shown in the '294 patent, with modifications.

Clip 40 is in the form of a right angle having legs 41 and 42. Leg 41 is of a single thickness of sheet metal and has a tab or ear 43 lanced out in a U-shape with the top of the U at 45 remaining integral with leg 41. Holes 44 receive screws 79. A space, slightly smaller in thickness than the thickness of face 32 of wall molding 30 is formed by tab 43.

Relatively small, pointed barbs 47 are lanced on each side of the tab 43. The points of barbs 47 are pointed upward in the clip. Leg 41 is generally rectangular in shape. An edge of leg 41 has extending therefrom one opposing web 52 of leg 42. Web 52 has at its top thereof, offset 53.

Leg 41 has formed at the top thereof bent portion 60 extending toward leg 42. Section 61 of portion 60 has an edge 62 that is connected to opposing web 63 of leg 42. Web 63 has an offset portion 65 corresponding to offset 53 on web 52.

A slot 70, extends in leg 42. The slot 70 extends through both sides of leg 42, in registry. The slot can be, for instance, 3/16 inch wide.

The slot has a combined length of about 2 inches, with a 1 inch long horizontal segment 91 forward from the mid-rest position 90, and a one inch long inclined segment 92 rearward from the rest position 90 and the wall 20. The inclined segment 92 of the slot 70 can, for instance, rise a distance of about 3/8 inch over its length to provide the required rise and fall for the flange 23 on the beam 22 to clear the ledge 33 on the angle wall molding 30 as beam 22 slides back and forth during an earthquake.

In the clip 40 of the present invention, the length of the leg 42, in the direction normal to leg 41, is about 2 and 3/8 inches, whereas, in the clip of the '294 patent, the length of leg 42 was not critical, in that there was no concern with a sliding beam during an earthquake. In the '294 patent, the beam 22 was secured in clip 40 at both ends of a line of connected beams 22, preventing any movement of the line. The present invention does not secure the beam 22 at one end of a line of connected beams, so that the end of the beam 22, and thus the line of connected beams, is free to slide at one end of the line with respect to the wall molding 30 during a quake, and still be supported on the wall molding 30. The leg 42 of the clip that supports the end of the beam is extended to about 2 3/8 inches to support the end of the beam during the sliding that results from the quake.

Figure 1:
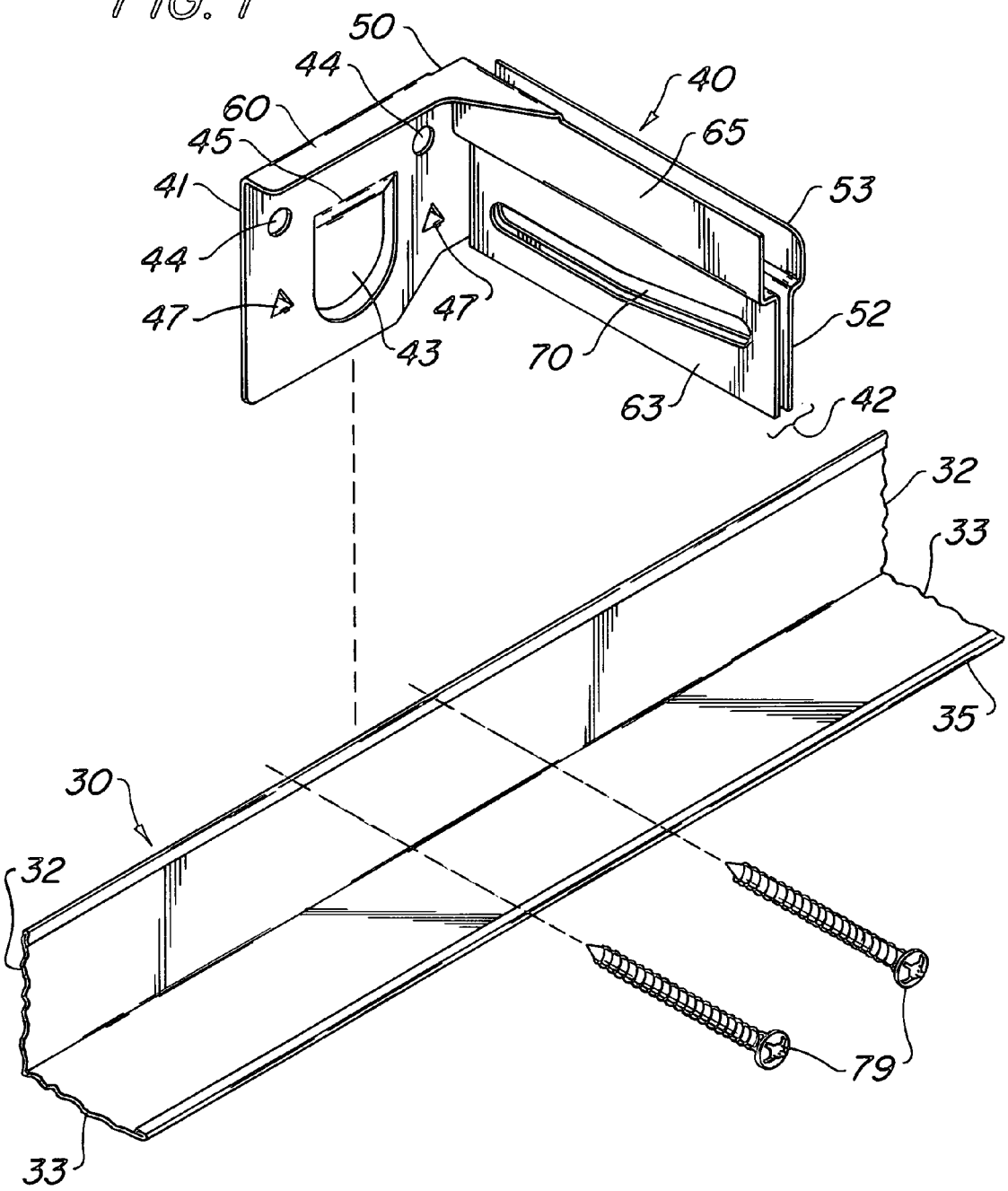
FIG. 1 is an isometric exploded view of the clip of the invention, with mounting screws, and a segment of an angle wall molding.

As with the '294 clip, the perimeter clip 40 of the invention is applied to the vertical face 32 of wall molding 30 by snapping tab 43 downward on the face until barbs 47 ride over upper fold 35 and, tab section 45 rests on the upper fold 35, as seen, for instance, in FIG. 2. Self-tapping screws 79, as seen in FIG. 1, secure the clip 40 through holes 44 to board 20, so the clip 40 cannot move horizontally along the wall molding 30 at rest or during a quake.

Clips 40 are positioned along the angle wall molding 30 at points predetermined by the intended position of the suspended ceiling grid. For instance, where the beams 22 are interconnected to form a 2 foot×4 foot grid, the clips 40 will be spaced at 4 foot intervals along one set of opposing walls, and at 2 foot intervals on the other set of opposing walls, in a rectangularly shaped room.

The end of the beam 22 is inserted into a clip 40 as seen in FIG. 2. Web 25 of beam 22 is inserted between opposing webs 52 and 63 of leg 42, and bulb 26 of the beam engages opposing ofsets 53 and 65. The webs 52 and 63 are so spaced from one another as to provide a snug, springy fit about the beam. The end of the beam 22 is held by the clip 40 above the ledge 33 of wall molding 30 so that virtually no weight of the beam 22 rests on the ledge 33. The end of beam 22, as seen in FIG. 2, is inserted into the clip 40 as described above, so that it rests at a position about ¾ inch away from the vertical face 32 of molding 30. As seen in FIG. 2, a self-tapping screw 71 is inserted through the slot 70 in web 63 of leg 42, into web 25, at the end of beam 22. The screw 71 pierces through the web 25 of beam 22 and then out through the slot 70 on the other web 52 of leg 42. The screw 71 has a diameter slightly smaller than the width of slot 70, so that the screw is free to travel along the slot during a quake, in the form of a sliding pin, as will be described. The screw 71 is not tightened at the end of the beam that is intended to slide.

In the event that it is desired to fix and secure the end of beam 22 in the clip 40, as discussed above, it is simply necessary to tighten screw 71 so that it fixes the beam 22 to the clip 40.

During an earthquake, the end of a line of connected beams 22 that is fixed in a clip 40, by tightened screw 71, will not move relative to molding 30 and wall 20. However, at the other end of the line of connected beams 22, the end of beam 22 is free to slide in clip 40, since screw 71 is not tightened. The movement of the end of beam 22 in clip 40 is a reciprocal one, forward toward the wall from rest position 90, and rearward from the wall and away from rest position 90.

Figure 3:
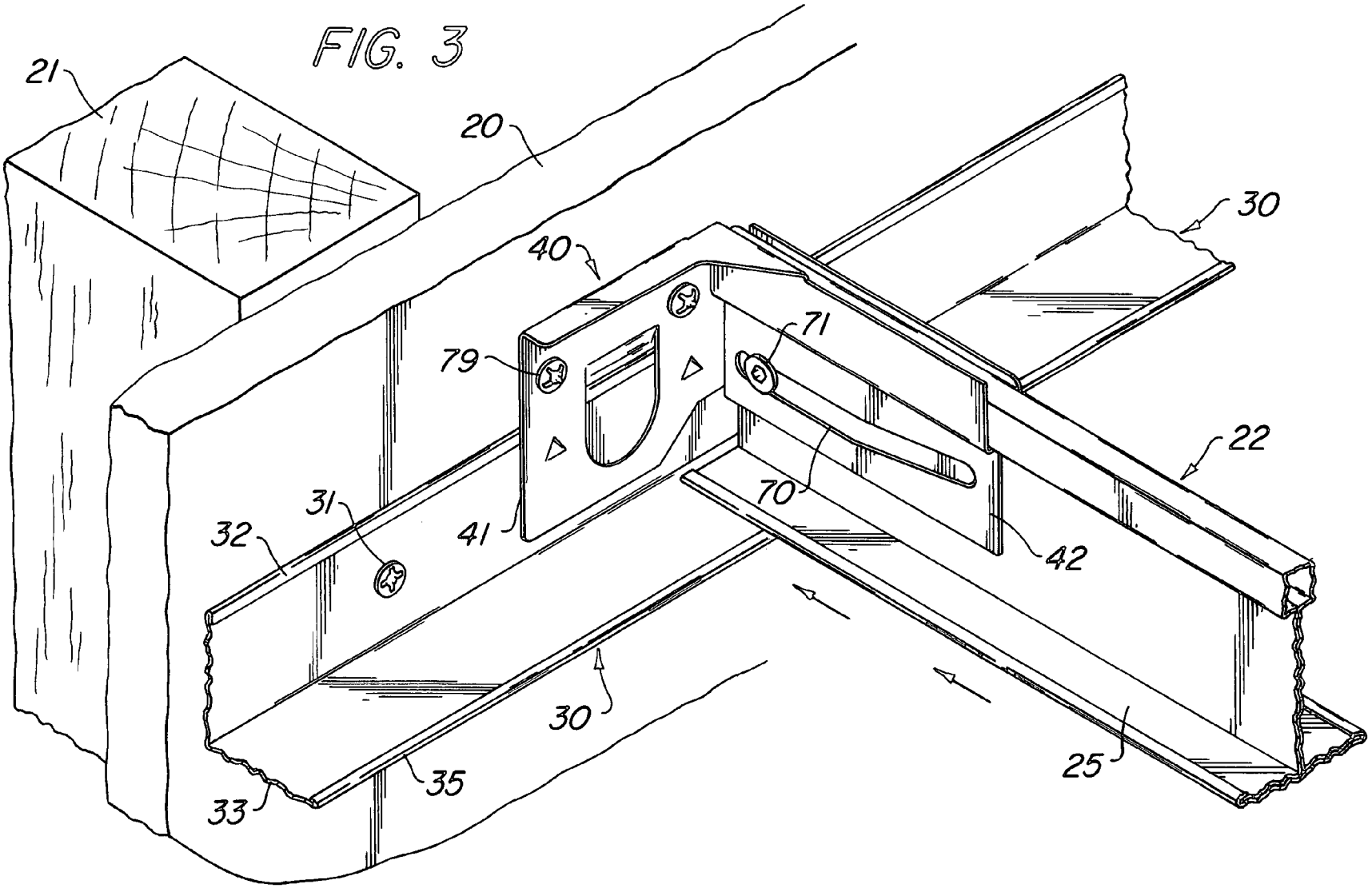
FIG. 3 is a view similar to FIG. 2 showing the end of a beam, during a seismic event, at a position toward the wall, from its rest position, where the beam is free to slide.
Figure 4:
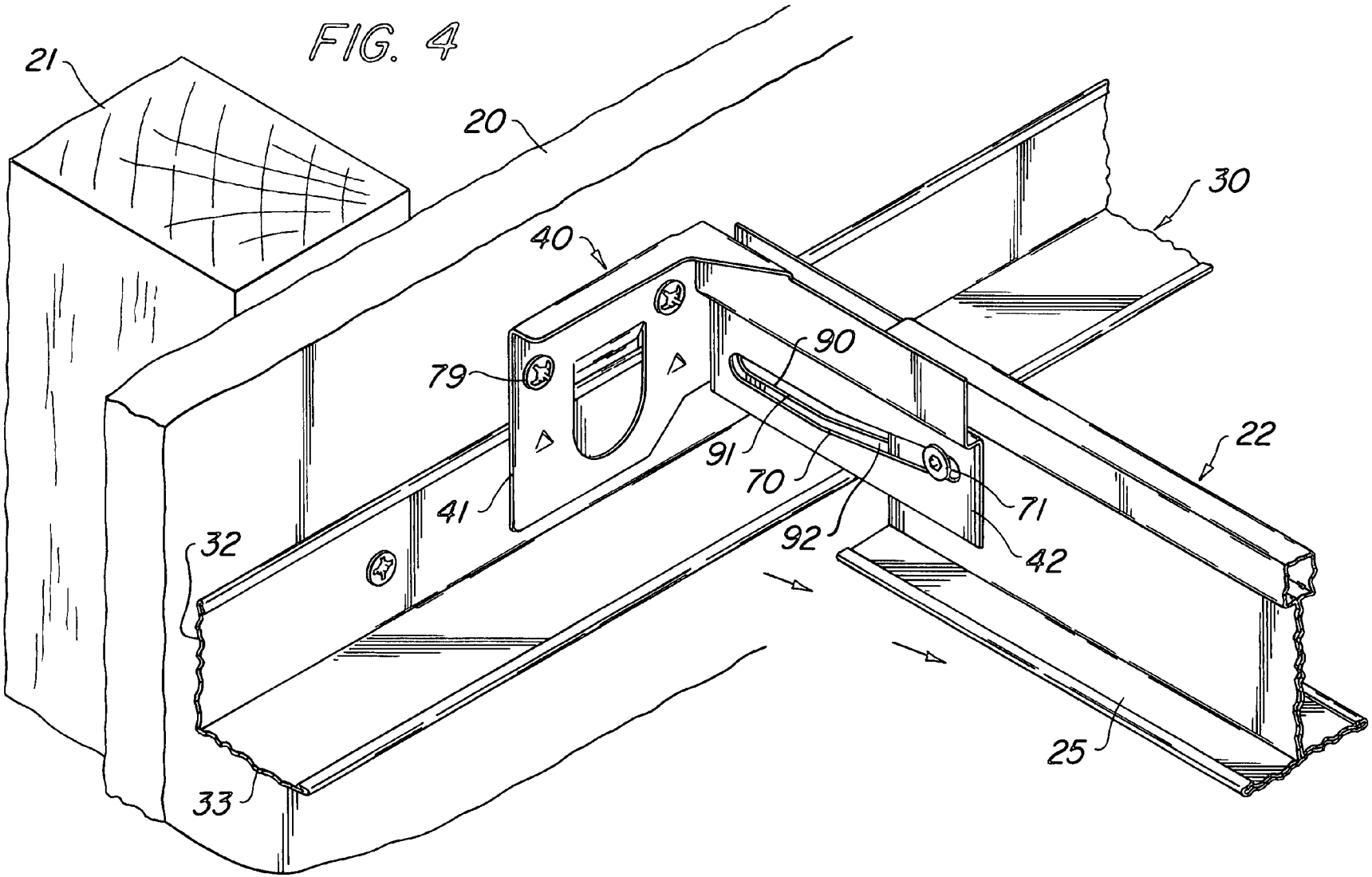
FIG. 4 is a view similar to FIG. 2, showing the beam end being supported at a position away from its rest position and away from the wall, beyond the ledge of the wall molding, during a quake, where the beam is free to slide.

As the end of beam moves toward the wall from rest position 90, as seen in FIG. 3, it is supported in the horizontal segment 91 of slot 70 by screw 71, and its movement remains horizontal. As the end of beam 22 reciprocates rearward, away from the wall 20, it travels again in a horizontal movement, until screw 71 reaches mid-position 90, at which point the end of the beam 22 is elevated as it moves toward its outermost position as shown in FIG. 4. In the segment 92 of the slot 70, the end of beam 22 is elevated as it moves beyond the ledge 33 of molding 30, as seen in FIG. 4.

As the end of beam 22 reverses direction and travels back toward the wall 20 and molding 30, the flange 27 on beam 22 is lowered until it reaches the rest position 90 as seen in FIG. 2. The action then repeats as the seismic event continues.

The action of the clip in elevating the end of beam 22 as it travels beyond ledge 32 of molding 30, as seen in FIG. 4, prevents interference between the beam and molding during the quake.

What is claimed is:

1. In a perimeter clip that (a) attaches to an angle wall molding having a face and a ledge, and (b) supports a beam end in a suspended ceiling, the perimeter clip having (a) a first leg that attaches to and extends along the wall molding, and (b) a second leg that supports the beam end and that extends away from the wall molding face at a right angle to the first leg;

the improvement comprising a slot in the second leg having (1) an inclined segment that extends upward and away from the first leg, and (2) a horizontal segment that extends toward the wall molding face from the inclined segment, wherein the slot receives a screw that extends through the slot into the web of the beam end being supported in the clip, with the screw being free to slide in the slot during an earthquake and support the beam end in the clip.

2. The clip of claim 1 wherein the screw is capable of being tightened in the slot to fix the beam end in the clip so that the beam end does not slide in the clip during an earthquake.

3. The clip of claim 1 wherein the beam end, during an earthquake, is elevated above the wall molding ledge at times during the slide of the screw in the slot, to prevent interference between the beam end and the wall molding ledge.

4. The clip of claim 3 wherein the beam end, during an earthquake, is elevated above the wall molding ledge during the slide of the screw in the inclined segment of the slot.

5. The use of the clip of claim 1 in a suspended ceiling in geographical zones prone to seismic events.

* * * * *